US005581282A

United States Patent [19]

Okamura

[11] Patent Number: 5,581,282

[45] Date of Patent: Dec. 3, 1996

[54] INK JET RECORDING APPARATUS WITH TWO CLEANING MEMBERS

[75] Inventor: Shigeru Okamura, Kawasaki, Japan

[73] Assignee: Canon Kabushiki Kaisha, Tokyo, Japan

[21] Appl. No.: 376,653

[22] Filed: Jan. 20, 1995

Related U.S. Application Data

[63] Continuation of Ser. No. 79,853, Jun. 22, 1993, abandoned, which is a continuation of Ser. No. 818,099, Jan. 8, 1992, abandoned, which is a continuation of Ser. No. 442,456, Nov. 30, 1989, abandoned, which is a continuation of Ser. No. 113,998, Oct. 29, 1987, abandoned.

[30] Foreign Application Priority Data

| | | | |
|---|---|---|---|
| Oct. 31, 1986 | [JP] | Japan | 61-260026 |
| Oct. 27, 1987 | [JP] | Japan | 62-270842 |

[51] Int. Cl.[6] ..... B41J 2/165

[52] U.S. Cl. ..... 347/33

[58] Field of Search ..... 347/33, 22; 15/250.19, 15/256.5

[56] References Cited

U.S. PATENT DOCUMENTS

| | | | |
|---|---|---|---|
| 3,987,492 | 10/1976 | Kraus | 347/43 |
| 4,024,548 | 5/1977 | Alonso | 347/34 |
| 4,320,406 | 3/1982 | Heinzl | 347/43 |
| 4,511,907 | 4/1985 | Fukuchi | 347/43 |
| 4,635,078 | 1/1987 | Sakurada et al. | 347/43 |
| 4,675,696 | 6/1987 | Suzuki | 347/43 |
| 4,745,414 | 5/1988 | Okamura et al. | 347/33 |
| 5,182,582 | 1/1993 | Okamura | 347/33 |

FOREIGN PATENT DOCUMENTS

| | | | |
|---|---|---|---|
| 3316970 | 11/1983 | Germany | B41J 3/04 |
| 3611333 | 10/1986 | Germany | B41J 3/04 |
| 3611666 | 10/1988 | Germany | B41J 3/04 |
| 59-14964 | 1/1984 | Japan | B41J 3/04 |
| 59-45161 | 3/1984 | Japan | B41J 3/04 |
| 209876 | 11/1984 | Japan | B41J 3/04 |
| 60-163571 | 8/1985 | Japan | B41J 3/04 |
| 61-230948 | 10/1986 | Japan | B41J 3/04 |
| 2113553 | 5/1987 | Japan | B41J 3/04 |

OTHER PUBLICATIONS

*IBM Technical Disclosure Bulletin*, vol. 27, No. 12, May 1985 "Nozzle Guard and Maintenance Station For Drop–on–Demand Print Heads".

Quinn Jr., P. A.; Disposable Porous Insert For Deflection Plate Of Ink Jet Printer, IBM TDB, V22, N8A, Jan. 1980, p. 3296.

*Primary Examiner*—Joseph W. Hartary

*Attorney, Agent, or Firm*—Fitzpatrick, Cella, Harper & Scinto

[57] ABSTRACT

An ink jet recording apparatus comprises a recording head having in a surface thereof ink discharge openings for discharging ink and a first cleaning member disposed at a non-recording area offset from a recording area and opposed to the recording head for removing foreign matter including ink by scrubbing the surface. A second cleaning member is disposed at a side area of the recording head for scrubbingly cleaning foreign matter including ink adhered to said first cleaning member. The second cleaning member has an introducing path into which is introduced the foreign matter including ink adhered to the first cleaning member and an absorbing member disposed at an end portion of the introducing path for collecting the foreign matter including ink introduced into the introducing path from the first cleaning member. In the apparatus different color inks are cleaned by the first cleaning member in the order of a lighter ink to a darker ink color.

9 Claims, 5 Drawing Sheets

21
23
24
50
49
C
6
5
4
3
3
2
III
1A
1B
1C
1D
37
36
III
18
19
20
16
14
15
21
I
23
25
17
13
B
12
24
RP
27
A
11
10
8
9
22D
22C
22B
22A
32
28
34
30
29
31
7

INK JET RECORDING APPARATUS WITH TWO CLEANING MEMBERS

This application is a continuation of application Ser. No. 08/079,853 filed Jun. 22, 1993, now abandoned, which in turn is a continuation of application Ser. No. 07/818,099 filed Jan. 8, 1992, now abandoned, which in turn is a continuation of application Ser. No. 07/442,456 filed Nov. 30, 1989, now abandoned, which in turn is a continuation of application Ser. No. 07/113,998 filed Oct. 29, 1987, now abandoned.

BACKGROUND OF THE INVENTION

1. Field of the Invention

The present invention relates to an ink jet recording apparatus having wiping means for cleaning the ink discharge port faces of the recording heads of the apparatus and to a method of cleaning such apparatus.

2. Related Background Art

An ink jet recording apparatus is such that ink is supplied into a recording head, discharge energy generating means (an electro-thermal converting member such as a heat generating resistor element or an electro-mechanical converting member such as a piezo element corresponding to an ink discharge port formed in the front face of the recording head) is driven on the basis of a data signal, ink is caused to fly from the ink discharge port toward a sheet (a recording medium such as paper or plastic thin film) and droplets of this ink are caused to adhere thereto, thereby accomplishing recording.

In an ink jet recording apparatus of this type, for the purpose of preventing the ink discharge port from being clogged due to the increased viscosity of ink resulting from the evaporation of the solvent in the ink, the desiccation of the ink, the adherence of dust or the entry of bubbles, there is provided restoring means for carrying out the capping of the ink discharge port or the cleaning of the ink discharge port face as by wiping.

The function of such restoring means can be divided broadly into the function of cleaning the ink discharge port face and the ink suction function of removing bubbles in the ink discharge port and ink which has increased in viscosity.

Now, in an ink jet recording apparatus for color images, use may be made of inks of plural colors and a plurality of recording heads corresponding to the respective colors. In such case, the colors of the inks used are usually four colors such as cyan, magenta, yellow and black.

Also, in some cases, recording is effected by the use of a plurality of inks identical in hue and differing in light and shade, and again in such cases, a plurality of recording heads are carried on the apparatus in conformity with the number of the inks.

In an ink jet recording apparatus provided with a plurality of recording heads for discharging such inks of plural colors respectively, cleaning means for cleaning the ink discharge port face of each recording head becomes necessary.

In such case, the provision of cleaning means for each recording head has led to the problem that the number of parts is increased and the structure of the apparatus becomes complex and the reliability of the apparatus is reduced. Also, juxtaposition of the cleaning means has led to a greater width of the recording apparatus, which in turn has prevented the apparatus from being made compact and light in weight.

If, therefore, all the ink discharge port faces of the plurality of recording heads are cleaned by a single cleaning means, there has sometimes arisen the problem that mixing of the inks of plural colors occurs on the cleaning means while the cleaning is repeatedly effected. This has sometimes resulted in the occurrence of the problem that the mixed inks having adhered to the cleaning means adhere from the cleaning means back to the ink discharge ports and the colors of the inks discharged from the ink discharge ports are changed thereby during the recording operation.

SUMMARY OF THE INVENTION

It is an object of the present invention to provide an ink jet recording apparatus which can solve the above-noted problems peculiar to the prior art and in which the ink discharge port faces of recording heads can be effectively cleaned by a simple structure, and a method of cleaning such apparatus.

In accordance with the present invention, an ink jet recording apparatus comprises recording means having in a surface thereof ink discharge openings for discharging ink, a first cleaning member disposed at a non-recording area offset from a recording area where recording is effected by said recording means and opposed to said recording means for removing foreign matter including ink by scrubbing said surface, and a second cleaning member, disposed at a side area of said recording means, for scrubbingly cleaning foreign matter including ink adhered to said first cleaning member, said second cleaning member having an introducing path into which is introduced the foreign matter including ink adhered to said first cleaning member and an absorbing member disposed at an end portion of said introducing path for collecting the foreign matter including ink introduced into said introducing path from said first cleaning member.

BRIEF DESCRIPTION OF THE DRAWINGS

FIGS. 6A, 6B, 6C and 6D are schematic fragmentary front views for illustrating the cleaning operation of the wiping means.

DESCRIPTION OF THE PREFERRED EMBODIMENT

The present invention will hereinafter be described specifically with reference to the drawings.

Figures 1, 2:
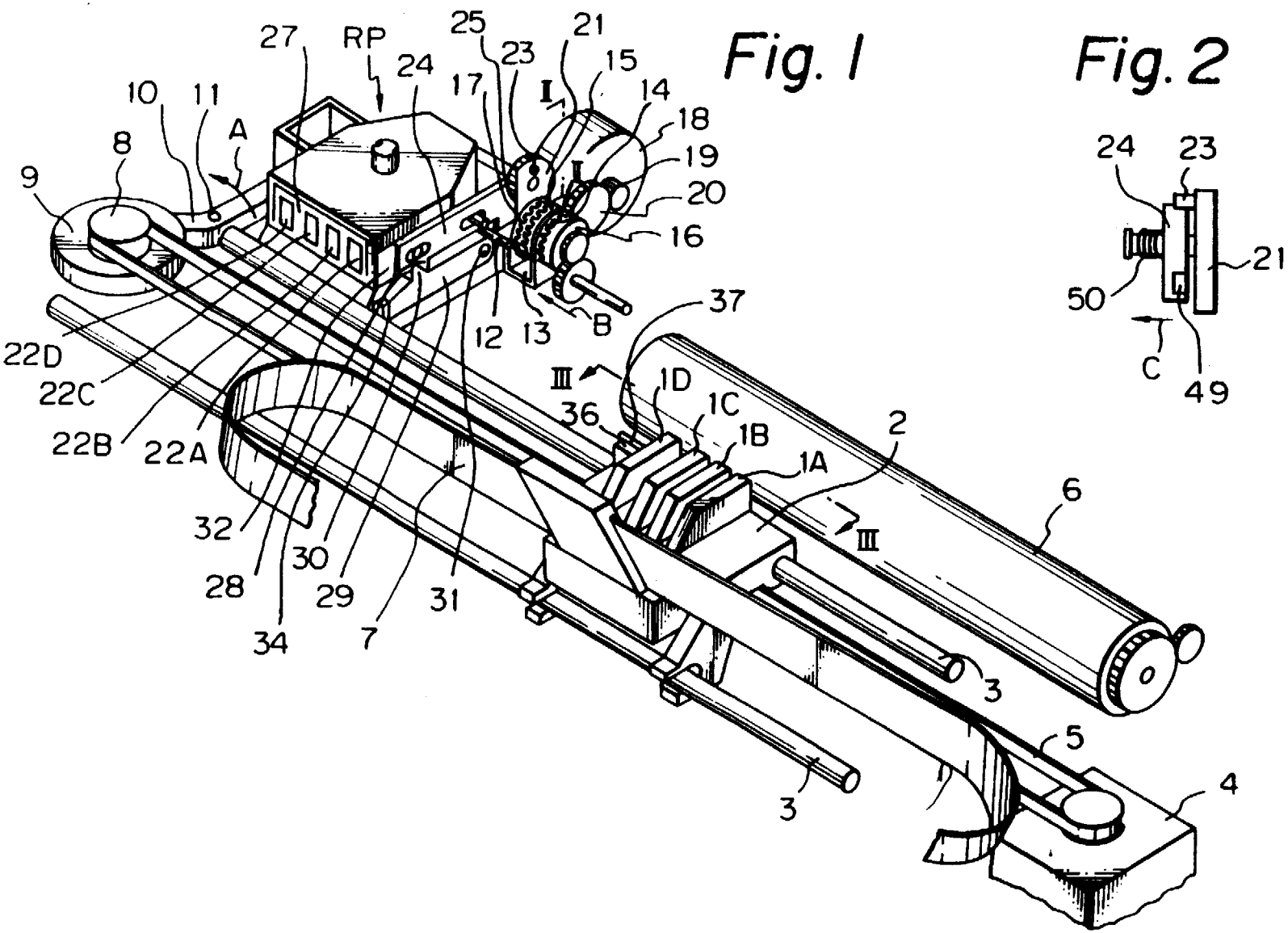
FIG. 1 is a schematic perspective view showing the construction of the essential portions of an embodiment of an ink jet recording apparatus according to the present invention.
FIG. 2 is a schematic front view taken along line II—II in FIG. 1.

FIG. 1 is a schematic perspective view showing the construction of the essential portions of an embodiment of the ink jet recording apparatus of the present invention.

In FIG. 1, a carriage 2 carrying a plurality of (in the illustrated embodiment, four) recording heads 1A, 1B, 1C and 1D is supported and guided by pair of guide shafts 3.

The drive force of a carriage motor 4 is transmitted to the carriage 2 through a timing belt 5, so that the carriage slides on the pair of guide shafts 3 and moves along a platen 6. The carriage 2 reciprocally scans with forward and reverse revolutions of the motor 4. A predetermined gap (for example, of the order of 0.8 mm) is provided between the front faces (the discharge port faces in which ink discharge ports are formed) of the recording heads 1A–1D on the carriage and the platen 6 (more particularly, a sheet supported by the platen).

During the scanning movement of the carriage 2, a recording signal is input to the recording heads 1A–1D through flexible wiring 7, and the recording heads 1A–1D are driven at a timing associated with the position of the carriage 2 to discharge inks, thereby accomplishing recording on a sheet (a recording medium such as paper or plastic thin film) on the platen 6.

During recording, dust or paper scraps may adhere to the vicinity of the ink discharge port(s) of the recording heads 1A–1D or air may be introduced through the ink discharge port(s), thereby causing unsatisfactory discharge of inks.

Generally, in an ink jet recording apparatus, there is installed restoring means RP for restoring such unsatisfactory discharge of inks.

When a restoring key (not shown) is operated to restore the unsatisfactory discharge of inks, the recording operation is interrupted and the carriage 2 is moved toward the restoring means RP.

With this movement of the carriage 2 toward the restoring means RP, an idle pulley 8 supporting the rotation of the timing belt 5 at one end thereof is rotated. With this rotation of the idle pulley 8, a planetary gear group 9 for speed reduction is also rotated which is provided coaxially therewith.

When the carriage 2 moves to a predetermined position toward the restoring means RP, a lever 10 engaged with a can slot in the last gear (not shown) of the planetary gear group 9 is pivotally moved about a shaft 11 in the direction of arrow A by an amount determined by the cam slot.

As the lever 10 is pivotally moved in the direction of arrow A, a stay 12 engaged with the fore end of the lever 10 slides in the direction of arrow B and a plate 13 fixed to the stay 12 also moves in the direction of arrow B.

This plate 13 is engaged with the circumferential groove 15 of a ratchet gear 14, which is free to rotate but is axially movable with the plate 13.

Accordingly, when the plate 13 moves in the direction of arrow B, the ratchet gear 14 is changed over from a state in which it is in meshing engagement with a ratchet gear 16 to a state in which it meshes with a ratchet gear 17.

Upon this change-over, the revolution of a sheet feeding motor (hereinafter referred to as the LF motor) 18 may be transmitted to the ratchet gear 17 through an LF motor gear 19, an idle gear 20 and the ratchet gear 14.

The ratched gear 17 has formed integrally therewith a gear portion which is in meshing engagement with a gear 21 with a dowel. This gear 21 with a dowel is the input gear of the restoring means RP and therefore, upon the aforementioned change-over to the direction of arrow B, the restoring means RP becomes driven by the LF motor 18.

The position of the carriage 2 is controlled with the home position detected by a home position sensor (not shown) installed at the left end portion being as the reference.

When the restoring key is operated as previously mentioned, the carriage 2 moves to a position in which the recording heads 1A–1D are opposed to corresponding caps 22A, 22B, 22C and 22D, respectively. In this position, as previously described, the LF motor 18 is changed over to the driving side of the restoring means RP and accordingly, the restoring operation is performed.

A wiping operation for cleaning the ink discharge port faces (the faces in which the ink discharge ports are formed) of the recording heads 1A–1D is carried out as one restoring operation, and wiping means therefor will hereinafter be described. This wiping means is designed to wipe the ink discharge port faces by means of a cleaning blade 24.

As the LF (line feed) motor 18 revolves, the gear 21 with a dowel is rotated and the dowel 23 comes into engagement with the rear end portion 25 of the cleaning blade 24, and the cleaning blade is protruded toward the carriage 2 against the force of a return spring (not shown) which biases the cleaning blade toward the LF motor 18.

The LF motor 18 is stopped when the gear 21 with a dowel has rotated from its initial position of FIG. 1 to a position in which the dowel 23 presses and displaces the rear end portion 25 of the cleaning blade 24.

By the aforementioned revolution of the LF motor 18, the rotary cam (not shown) of the restoring means RP which rotates at the final deceleration is also rotated at the same time, and a cap housing 27 which supports rubber caps 22A–22D tends to move toward the recording heads 1A–1D, but since the reduction ratios of the gear 21 with a dowel and the rotary cam of the restoring means RP from the LF motor 18 differ greatly from each other, the movement of the cap housing 27 can be neglected, and the gaps between the caps 22A–22D and the recording heads 1A–1D hardly vary, and the caps and the recording heads do not contact with each other.

Figure 5:
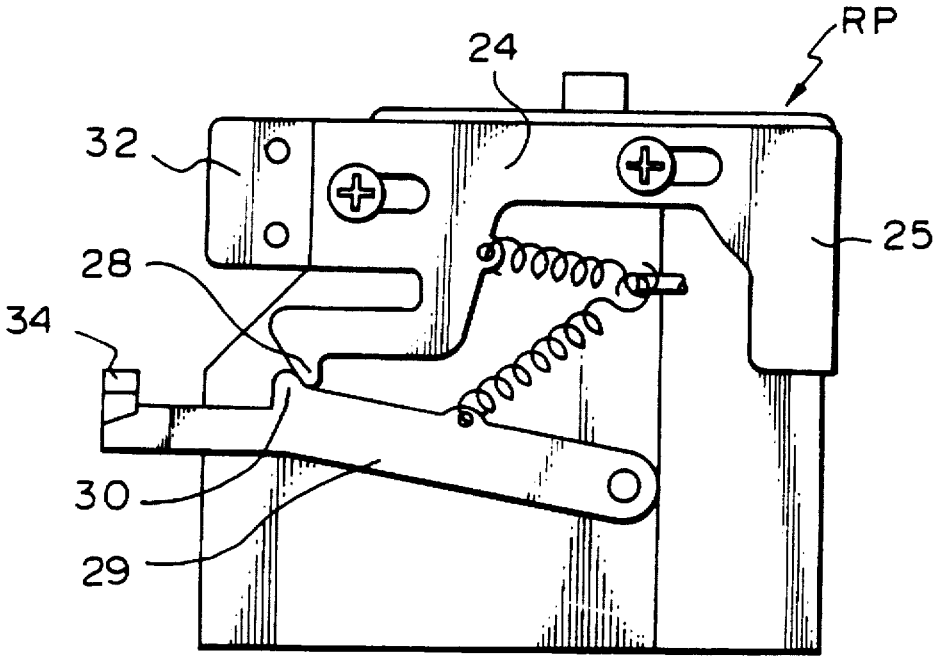
FIG. 5 is a schematic side view of wiping means taken along line V—V in FIG. 4.

When the cleaning blade 24 constituting the wiping means is protruded by the rotation of the gear 21 with a dowel, the pawl 28 of the cleaning blade 24 depresses the pawl 30 of a holding lever 29 pivotally connected to the lower portion thereof and operates so as to ride over the latter (FIG. 5).

Accordingly, the holding lever 29 is rotated counter-clockwise direction about a lever shaft 31 against the force of a return spring (not shown), and the pawl 28 of the cleaning blade 24 is caught by the pawl 30 of the holding lever 29, whereby the cleaning blade 24 is held in its protruded position.

With the cleaning blade 24 being protruded, the carriage 2 is moved toward the platen 6 (rightwardly as viewed in FIG. 1), and wiping of the ink discharge port faces of the recording heads 1A–1D is effected by a blade 32 attached to the tip end of the cleaning blade 24.

Figure 3:
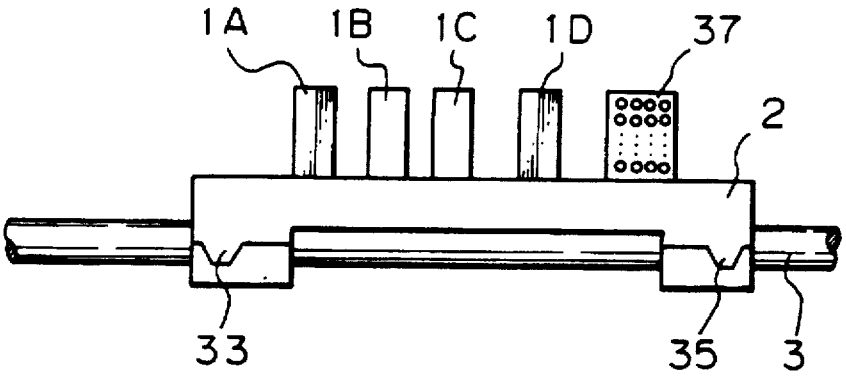
FIG. 3 is a schematic front view of a carriage taken along line III—III in FIG. 1.
Figure 4:
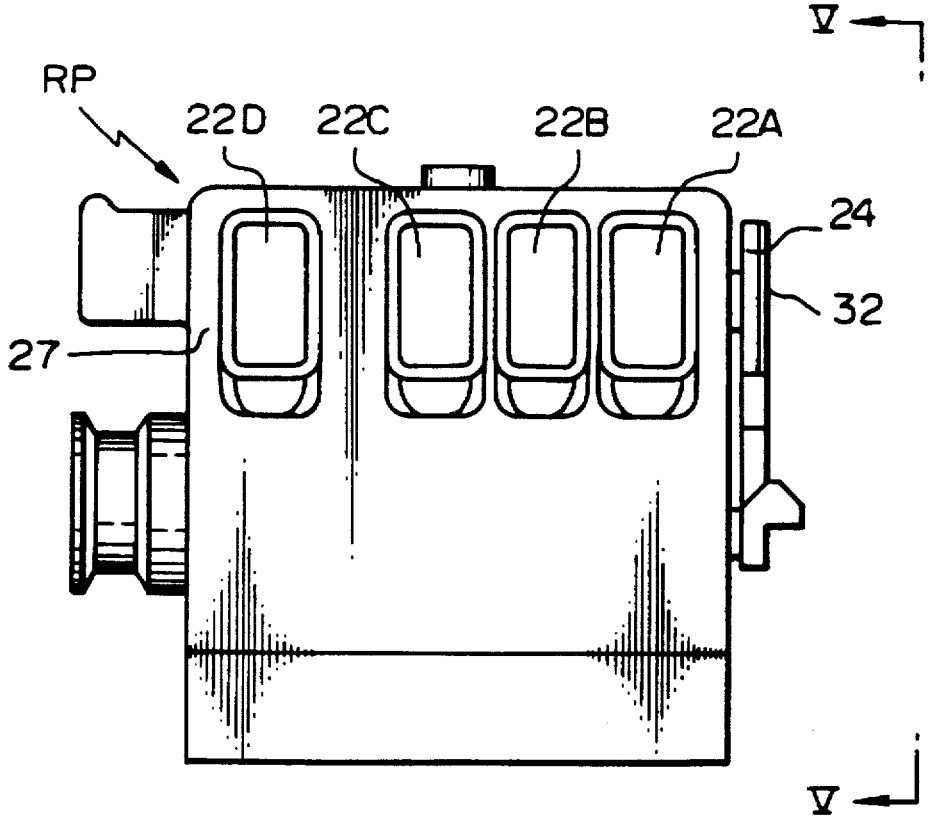
FIG. 4 is a schematic front view showing the restoring means in FIG. 1.

When the carriage 2 is thus moved from left to right, the resetting pawl 33 (FIG. 3) of the carriage 2 comes into engagement with the end pawl 34 of the holding lever 29, and the holding lever 29 is depressed counter-clockwise as viewed in FIG. 1, whereby the engagement between the pawl 28 of the cleaning blade 24 and the pawl 30 of the holding lever 29 is released temporarily.

Therefore, the cleaning blade 24 tends to retract away from the recording heads 1A–1D due to the action of a return spring (FIG. 5), but in this case, the cleaning blade 24 is prevented from retracting by the gear 21 with a dowel and therefore, even if the resetting pawl 33 of the carriage 2 passes, the cleaning blade 24 is held in its protruded position.

During the time that the carriage 2 is further moved rightwardly, wiping of the ink discharge port faces of the recording heads 1A–1D is effected.

In this case, in the period which is before the revolutionary force of the LF motor 18 is changed to the platen 6 driving side by the movement of the carriage 2 and during which the pawl 30 of the holding lever 29 is positioned between the pair of resetting pawls 33 and 35 (FIG. 3) of the carriage 2, the LF motor 18 is changed over to the reverse revolution opposite to the forward revolution during the restoring operation and is reversely revolved to its initial position, and the gear 21 with a dowel is returned to its position of FIG. 1.

By the reverse revolution of the LF motor 18, the gear 21 with a dowel makes one or more full reverse rotations, but in that case, the dowel 23 of the gear 21 with a dowel passes through an escape groove 49 (FIG. 2) at the rear end 25 of the cleaning blade 24 and gradually returns to its original position while raising the cleaning blade 24 in the direction of arrow C (FIG. 2) against the force of a spring 50 (FIG. 2). Therefore, the cleaning blade 24 does not protrude to the ink discharge port side.

The sequence of wiping of the plurality of recording heads 1A–1D is chosen such that the recording head for discharging ink of light color is cleaned at first and the recording head for discharging ink of dark color is cleaned lastly. By this, color mixing in the course of wiping can be made entirely inconspicuous.

For example, where the ink jet recording apparatus of FIG. 1 is a color printer using inks of four colors, i.e., cyan, magenta, yellow and black, it is preferable the recording head 1A to be wiped at first be one which discharges yellow ink and the recording head 1D to be wiped lastly be one which discharges black ink. The intermediate recording heads 1B and 1C are chosen to be cyan and magenta respectively.

Yellow, cyan, magenta and black herein referred to, if expressed specifically in numerical values by "CIE 1976 ( L*a*b* ) Color Space" defined by C. I.E. (International Illumination Committee), are colors in the vicinity of the following:

| | L* | a* | b* |
|---|---|---|---|
| Yellow | 97 | −10 | 42 |
| Cyan | 79 | −32 | −33 |
| Magenta | 73 | 65 | −16.5 |
| Black | 43 | 10 | −20 |

In the case of a recording apparatus using light and dark inks of the same hue, it is preferable to choose a light color to a dark color in the order of the recording heads 1A–1D.

The definition of the, "light color" and "dark color" when use is made of light and dark inks of the same hue is as follows:

Light color: high in brightness, high in chroma

Dark color: low in brightness, low in chroma

Examples of the light color and dark color in the present invention are shown in Table 1 below.

TABLE 1

| No. | 1 | 2 | 3 | 4 |
|---|---|---|---|---|
| Light color | Yellow | Yellow | Yellow | Cyan |
| Dark color | Cyan | Magenta | Black | Black |

| No. | 5 | 6 | 7 |
|---|---|---|---|
| Light color | Magenta | Yellow (high brightness) | Yellow (high chroma |
| Dark color | Black | Yellow (low brightness) | Yellow (low chroma) |

| No. | 8 | 9 | 10 |
|---|---|---|---|
| Light color | Cyan (high brightness) | Cyan (high chroma) | Magenta (high brightness) |
| Dark color | Cyan (low brightness) | Cyan (low chroma) | Magenta (low brightness) |

| No. | 11 | 12 | 13 |
|---|---|---|---|
| Light color | Megenta (high chroma) | Black (high brightness) | Black (high chroma) |
| Dark color | Magenta (low chroma) | Black (low brightness) | Black (low chroma) |

In the present invention, where use is made of ink A of a certain color and ink B of a different color, when the color of the mixture of these inks is more approximate to the color of said ink B than to the color of said ink A, the color of said ink A is regarded as light color and the color of said ink B is regarded as dark color.

Removal of foreign substances such as ink droplets or dust which have adhered to the cleaning blade 24 by the ink discharge port faces being wiped is effected, for example, by the use of second cleaning means having a rigid support plate 37 provided on the carriage and an absorber 36 supported by the support plate 37.

After the termination of the cleaning of the discharge port faces of the recording heads 1A, 1B, 1C and 1D (the state of FIG. 6A), the carriage 2 is further moved in the direction of arrow FD, and in the state of FIG. 6B, foreign substances such as ink droplets or dust having adhered to that side of the cleaning blade 24 which is designated by 24-1 are removed by the edge 37-1 of the support plate 37 and absorbed by the absorber 36. Removal of foreign substances such as ink droplets or dust having come round and adhered to that side of the cleaning blade 24 which is designated by 24-2 is accomplished by moving the carriage 2 to the state of FIG. 6C relative to the cleaning blade 24, thereafter moving the carriage 2 in the direction of arrow BK, removing the foreign substances by the edge 37-2 of the support plate 37 in the state of FIG. 6D, and absorbing the foreign substances by the absorber 36.

The carriage 2 is further moved from the state of FIG. 6D, and the cycle of removing the ink droplets having adhered to the cleaning blade 24 is terminated in the state of FIG. 6A.

Removal of ink droplets may be accomplished by the cycle of returning from the operation in the above-described sequence of FIGS. 6A, B, C and D to the state of FIG. 6A via the movement in the direction of arrow C (FIG. 2) and repeating a similar operation, and the cleaning effect will be further enhanced if such cycle is repeated plural times.

Figure 7:
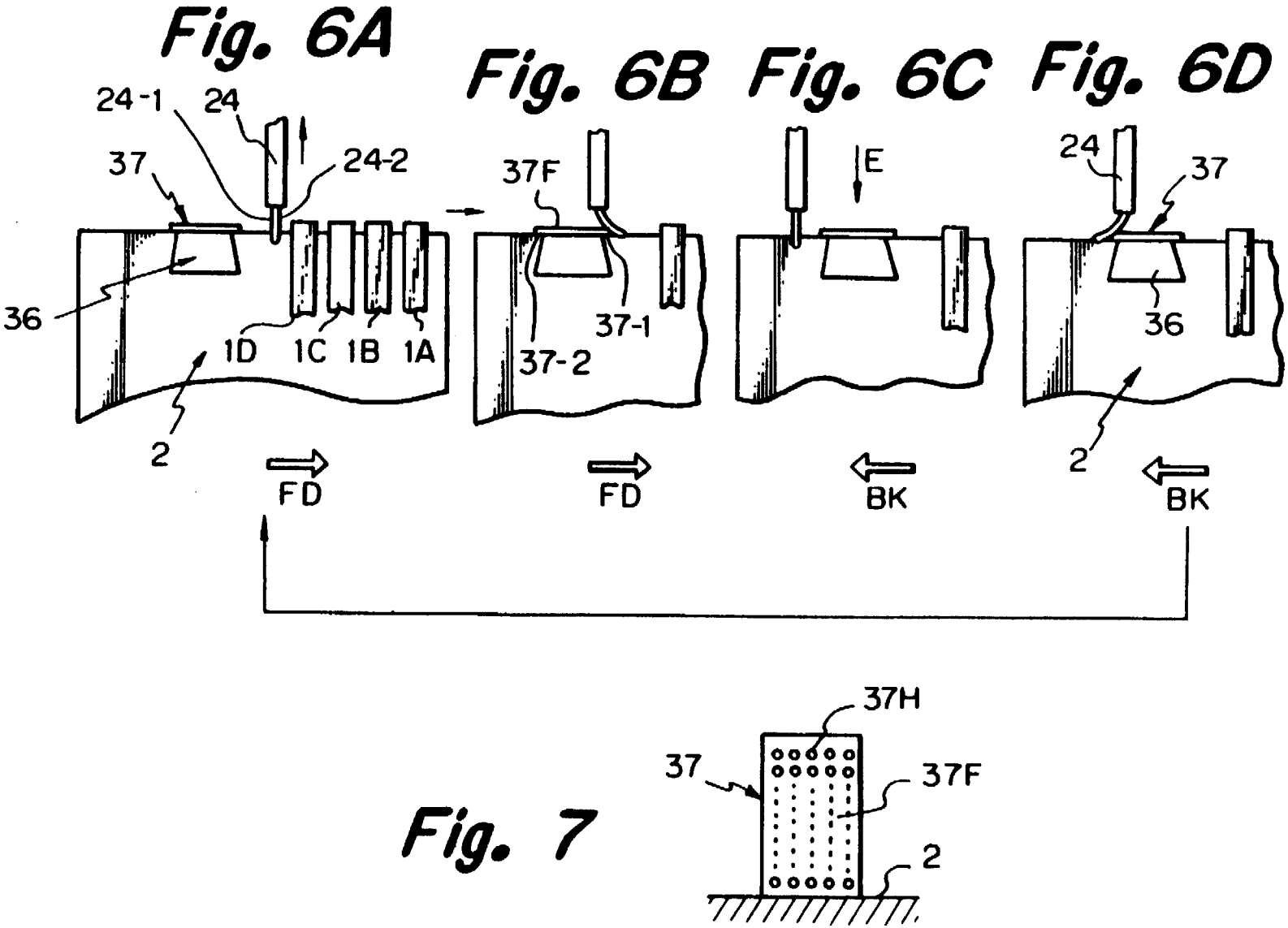
FIG. 7 is a schematic front view of a support plate 35 in FIGS. 6A, 6B, 6C and 6D.

In FIG. 7 which shows a schematic front view of the support plate 37 for the absorber 36 as seen in the direction of arrow E in FIG. 6C, a number of small apertures 37H are formed in the flat portion 37F of the support plate 37 for the absorber 36, and ink droplets which could not be removed by the edges 37-1 and 37-2 during the aforedescribed operation of removing the ink droplets having adhered to the cleaning blade 24 move into the small apertures 37H due to the capillary force of the small apertures 37H during the time that the cleaning blades 24-1 and 24-2 lick the flat portion 37F. The apertures provide an introducing path through which the ink droplets containing the foreign matter led to and absorbed by the absorber 36 at the terminal end of the introducing path.

The above-described cleaning operation by the wiping means may be executed plural times with the carriage 2 reciprocally moved.

Figure 8:
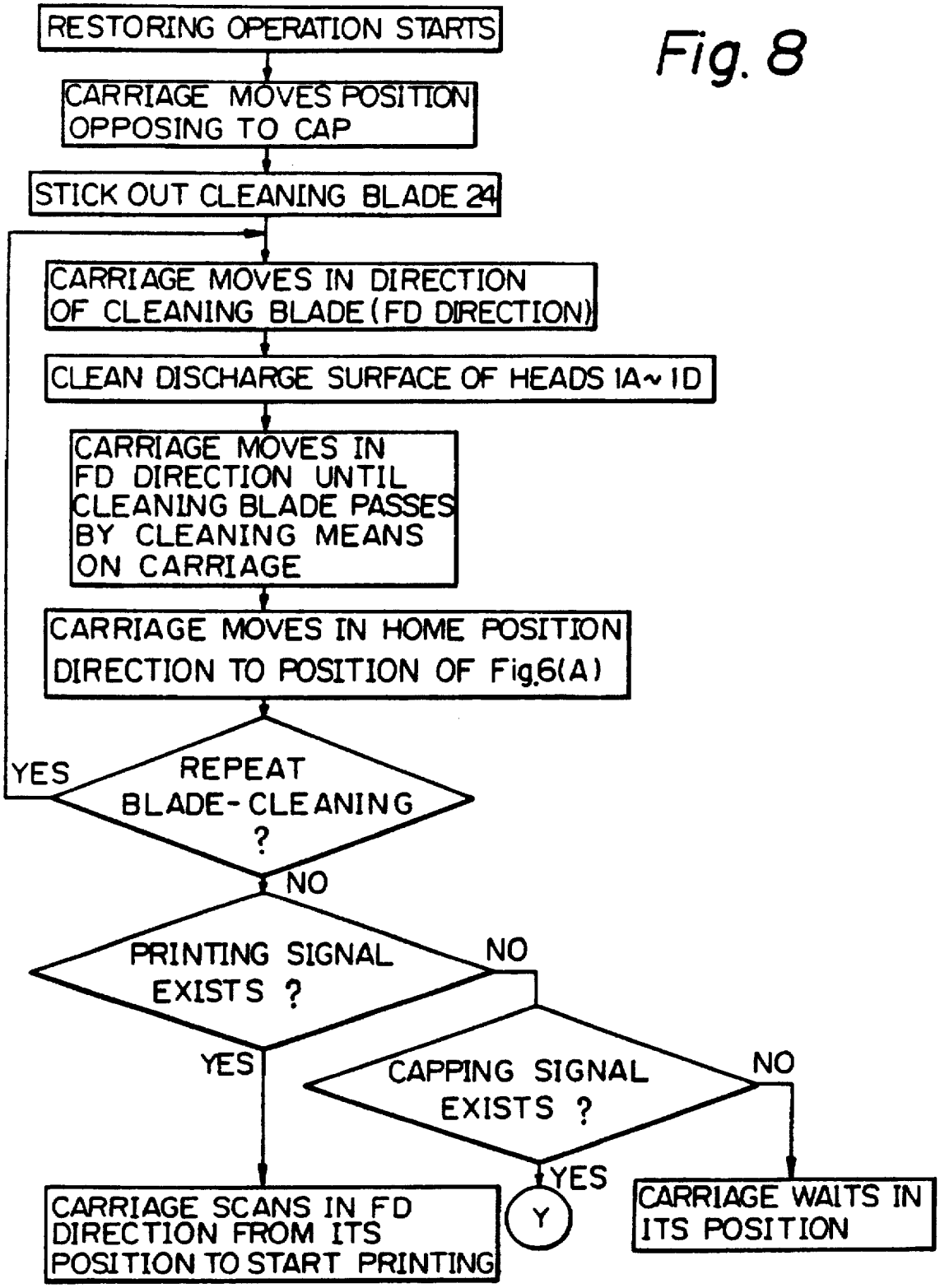
FIG. 8 is a flow chart for explaining the restoring operation of the ink jet recording apparatus of the present invention.

The flow of the above-described wiping of the discharge port faces of the recording heads 1A–1D and cleaning of the cleaning blade 24 will now be supplementally described with reference to the restoring operation flow chart of FIG. 8.

Cleaning of the recording heads 1A–1D and cleaning blade 24 is terminated and the carriage 2 waits in the position of FIG. 6A relative to the cleaning blade 24. (See the step at which the carriage 2 moves to the position of FIG. 6A toward the home position.) At this step, the carriage 2 moves from the position of FIG. 6C to the position of FIG. 6A via the position of FIG. 6D.

The subsequent steps between the step at which the discharge port faces of the recording heads 1A–1D are cleaned and the step at which the carriage 2 moves to a predetermined position (until the blade 24 passes by the cleaning means) are the steps for cleaning the blade. The step at which the carriage 2 moves to the predetermined position corresponds to FIGS. 6A–C.

Advance is made to a step at which whether cleaning of the blade 24 should be repeated is judged, and if it is desired to repeat the cleaning, it is also possible to skip between a step at which the blade 24 is protruded and a step at which the carriage 2 moves toward the blade 24. At the step whereat the necessity of repeating the cleaning of the blade 24 is judged, if the answer is NO, advance is made to a step at which the presence of a printing signal is judged, and if judgment YES is formed at that step, the carriage 2 moves in the direction of arrow FD and starts printing from a predetermined position. At that-time, the cleaning blade 24 goes through the states of FIGS. 6B and C. The cleaning blade 24 returns to its initial position by the resetting pawl 35 of the carriage 2 depressing the holding lever 29.

When no printing signal is present (that is, when judgment NO is formed), advance is made to a step at which the presence of a capping signal is judged, and when no capping signal is present (that is, when judgment NO is formed), the carriage 2 waits in that position. On the other hand, when a capping signal is present (that is, when judgment YES is formed), advance is made to step Ⓨ.

Step Ⓨ will now be described. Step Ⓨ is the state of FIG. 6(A) and therefore, when the carriage 2 is scanned toward the home position (in the direction of arrow BK), the cleaning blade 24 will wipe the discharge port faces of the recording heads in the direction from the head 1D toward the head 1A. For this reason, the carriage 2 is once scanned in the direction of arrow FD and the cleaning blade 24 is returned to its initial position by the resetting pawl 35, whereafter the carriage 2 may be scanned in the direction of arrow BK.

While the above embodiment has been described with respect to a case where the discharge port faces of a plurality of recording heads for discharging inks of plural colors are wiped, the present invention is not restricted thereto.

For example, the present invention is also applicable to the wiping of the discharge port face of a recording head having a plurality of discharge ports for discharging inks of plural colors.

Figure 9:
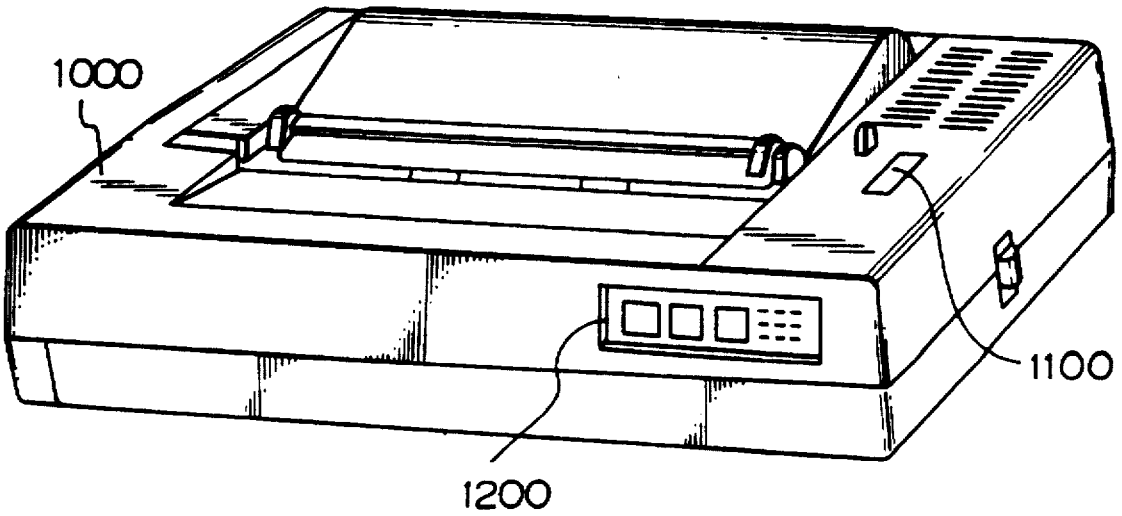
FIG. 9 is a schematic pictorial perspective view showing the ink jet recording apparatus of the present invention.

Referring to FIG. 9 which is a schematic pictorial perspective view showing an embodiment of the ink jet recording apparatus of the present invention, the reference numeral 1000 designates an ink jet recording apparatus body, the reference numeral 1100 denotes a main switch, and the reference numeral 1200 designates an operating panel.

According to the embodiment described above, the ink discharge port faces of the plurality of recording heads 1A–1D are effectively wiped in a predetermined order by a single cleaning blade 24, whereby dust, paper scraps or viscosity-increased ink adhering to the ink discharge port faces of the recording heads can be reliably removed.

Also, since wiping of the recording heads 1A–1D is carried out by one and the same cleaning blade 24, the structure of the wiping means can be made fewer in the number of parts and simple as well as compact and highly reliable, and this leads to the possibility of compactness, lighter weight and reduced cost of the ink jet recording apparatus.

As is apparent from the foregoing description, according to the present invention, the wiping means for cleaning the ink discharge port faces of the recording heads can be made simple and compact and improved in reliability, whereby there can be provided an ink jet recording apparatus which can generally be made light in weight and compact.

I claim:

1. An ink jet recording apparatus comprising:

recording means having in a surface thereof ink discharge openings for discharging ink;

a first cleaning member disposed at a non-recording area offset from a recording area where recording is effected by said recording means and opposed to said recording means for removing from said surface ink and particulate foreign matter by scrubbing said surface during relative movement of said recording means and said first cleaning member; and a second cleaning member having a rigid member for contacting and deforming said first cleaning member during relative movement of said first cleaning member and said second cleaning member to scrubbingly clean ink and particulate foreign matter adhered to said first cleaning member, said second cleaning member including an absorbing member and said rigid member having an introducing path by which the ink and particulate foreign matter cleaned from said first cleaning member are led to said absorbing member disposed at a terminal end of said introducing path for trapping the ink and particulate foreign matter introduced into said introducing path from said first cleaning member.

2. An ink let recording apparatus according to claim 1, wherein said recording means comprises plural members for recording using different color inks to effect full color recording, said different color inks are cleaned by said first cleaning member in the order of a lighter ink to a darker ink color, a given ink being lighter than another ink if the color of a mixture of those two inks is closer to the color of the other ink than to the color of the given ink, and said first cleaning member is thereafter cleaned by said second cleaning member.

3. An ink jet recording apparatus according to claim 1, wherein the cleaning of said recording means by said first cleaning member and the cleaning of said first cleaning member by said second cleaning member are performed plural times.

4. An ink jet recording apparatus according to claim 1, wherein the cleaning of said first cleaning member by said second cleaning member is performed plural times.

5. An ink jet recording apparatus according to claim 1, further comprising moving means for moving said recording means and said second cleaning member relative to said first cleaning member.

6. An ink jet recording apparatus according to claim 1, wherein said introducing path includes at least one hole through said rigid member.

7. A method of cleaning an ink jet recording apparatus comprising recording means having in a surface thereof ink discharge openings for discharging ink, a first cleaning member disposed at a non-recording area offset from a recording area where recording is effected by said recording means and opposed to said recording means for removing from said surface ink and particulate foreign matter by scrubbing said surface during relative movement of said recording means and said first cleaning member, and a second cleaning member having a rigid member for contacting and deforming said first cleaning member during relative movement of said first cleaning member and said second cleaning member to scrubbingly clean ink and particulate foreign matter adhered to said first cleaning member, said second cleaning member including an absorbing member and said rigid member having an introducing path by which the ink and particulate foreign matter cleaned from said first cleaning member are led to said absorbing member disposed at a terminal end of said introducing path for trapping the ink and particulate foreign matter introduced into said introducing path from said first cleaning member, and said method comprising the steps of:

moving said recording means and said first cleaning member relative to each other to scrub said surface with said first cleaning member;

thereafter moving said first cleaning member and said second cleaning member relative to each other in a first direction to scrubbingly clean a first side of said first cleaning member; and thereafter moving said first cleaning member and said second cleaning member relative to each other in a second direction to scrubbingly clean a second side of said first cleaning member.

8. An ink jet recording apparatus according to claim 7, wherein said recording means comprises plural members for recording using different color inks to effect full color recording, said different color inks are cleaned by said first cleaning member in the order of a lighter ink to a darker ink color, a given ink being lighter than another ink if the color of a mixture of those two inks is closer to the color of the other ink than to the color of the given ink, and said first cleaning member is thereafter cleaned by said second cleaning member.

9. A method of cleaning an ink jet recording apparatus according to claim 7, wherein said introducing path includes at least one hole through said rigid member.

* * * * *

UNITED STATES PATENT AND TRADEMARK OFFICE

CERTIFICATE OF CORRECTION

PATENT NO. : 5,581,282
DATED : Dec. 3,1996
INVENTOR(S) : Shigeru Okamura

It is certified that error appears in the above-indentified patent and that said Letters Patent is hereby corrected as shown below:

On the title page: after Item [45] insert * after Item [73] [*] Notice insert the following -- The term of this patent shall not extend beyond the expiration date of Patent No. 5,182,582 --.

Signed and Sealed this

Eighth Day of April, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,581,282
DATED : Dec. 3, 1996
INVENTOR(S) : Shigeru Okamura

It is certified that error appears in the above-indentified patent and that said Letters Patent is hereby corrected as shown below:

On title page, after item [73] insert --The term of this patent shall not extend beyond the expiration date of Pat. No. 5,182,582.--

Signed and Sealed this

Twenty-seventh Day of May, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,581,282

DATED : DECEMBER 3, 1996

INVENTOR(S) : SHIGERU OKAMURA

It is certified that error appears in the above-identified patent and that said Letters Patent is hereby corrected as shown below:

ON THE COVER PAGE

Add the following:
--[*] Notice: The portion of the term of this patent subsequent to January 26, 2010 has been disclaimed.--.

AT [45] Date of Patent:

"Dec. 3, 1996" should read --* Dec. 3, 1996--.

AT [56] References Cited, FOREIGN PATENT DOCUMENTS,

"2113553" should read --62-113553--.

COLUMN 2

Line 55, "plate 35" should read --plate 37--.

COLUMN 5

Line 45, "(" should be deleted.
Line 46, "L" should read --(L-- and
"C. I.E." should read --C.I.E.--.
Line 60, "the," should read --the--.

COLUMN 7

Line 12, "led" should read --are led--.
Line 46, "that-time," should read --that time,--.
Line 47, "C." should read --6C.--.
Line 59, "6(A)" should read --6A--.

UNITED STATES PATENT AND TRADEMARK OFFICE

CERTIFICATE OF CORRECTION

PATENT NO. : 5,581,282

DATED : DECEMBER 3, 1996

INVENTOR(S) : SHIGERU OKAMURA

It is certified that error appears in the above-identified patent and that said Letters Patent is hereby corrected as shown below:

COLUMN 10

Line 18, "An" should read --A method of cleaning an--.

Signed and Sealed this

Eighth Day of July, 1997

Bruce Lehman

*Attest:*

BRUCE LEHMAN

*Attesting Officer*

*Commissioner of Patents and Trademarks*